United States Patent [19]

Becker et al.

[11] 4,383,800

[45] May 17, 1983

[54] CENTRIFUGAL PUMP WITH OPEN DOUBLE VOLUTE CASING

[75] Inventors: Karl-Heinz Becker, Worms; Peter Milla, Beindersheim; Peter Hergt, Ludwigshafen; Heinz-Dieter Hellmann, Grünstadt, all of Fed. Rep. of Germany

[73] Assignee: Klein-Schanzlin & Becker Aktiengesellschaft, Frankenthal, Fed. Rep. of Germany

[21] Appl. No.: 226,751

[22] Filed: Jan. 21, 1981

[30] Foreign Application Priority Data

Feb. 12, 1980 [DE] Fed. Rep. of Germany ..... 3005094

[51] Int. Cl.[3] ..... F01D 11/00; F01D 25/24; F04D 1/00

[52] U.S. Cl. ..... 415/219 C; 415/101

[58] Field of Search ..... 415/93, 98, 99, 101, 415/184, 187, 198.1, 206, 207, 219 A, 219 B, 219 C; 416/184

[56] References Cited

U.S. PATENT DOCUMENTS 3,671,138 6/1972 Ball ..... 415/101

FOREIGN PATENT DOCUMENTS 2640866 6/1977 Fed. Rep. of Germany .

*Primary Examiner*—Philip R. Coe
*Assistant Examiner*—Timothy F. Simone
*Attorney, Agent, or Firm*—Kontler, Grimes & Battersby

[57] ABSTRACT

The double volute casing of a centrifugal pump has a main portion which has first and second volutes extending along arcs of not more than 180 degrees. The outer diameter of the main portion equals or approximates the outer diameter of the end of the first volute, and such end is adjacent to the start of the second volute whose end communicates with an outlet nozzle of the main portion. The latter has two channels which flank the second volute and extend between the end of the first volute and the outlet nozzle. The inner sides of the channels are open and face the axial passage of the main portion. Such inner sides are sealed from the axial passage by tubular inserts which are installed in and are separably fastened to the main portion of the casing. The passage receives a single-suction or a double-suction impeller or a stationary guide wheel which is located downstream of the impeller. The main portion of the casing is a one-piece casting.

12 Claims, 3 Drawing Figures

CENTRIFUGAL PUMP WITH OPEN DOUBLE VOLUTE CASING

CROSS-REFERENCE TO RELATED CASE

The centrifugal pump of the present invention constitutes an improvement over and a further development of the centrifugal pump which is disclosed in the commonly owned copending application Ser. No. 225,007 filed Jan. 14, 1981 for "Centrifugal pump with double volute casing".

BACKGROUND OF THE INVENTION

The present invention relates to improvements in centrifugal pumps of the type having double volute casings. More particularly, the invention relates to improvements in a centrifugal pump wherein the casing has two similar or identical volutes extending along arcs of maximally 180 degrees and facing each other across the axial passage of the casing. Such passage receives the pump shaft and the impeller which receives motion from the pump shaft, or a guide wheel which is installed downstream of the impeller.

The aforementioned commonly owned copending application for "Centrifugal pump with double volute casing" discloses that the dimensions of the casing can be reduced by selecting the outer diameter of the casing in such a way that it equals or approximates the outer diameter of the end of the first volute, namely, that portion of the first volute which is adjacent to the start of the second volute. The aforesaid copending application further discloses the possibility of providing a common outlet nozzle for the two volutes whereby the end of the second volute communicates directly with the outlet nozzle and the latter communicates with the end of the first volute by one or more channels which are provided in the casing and extend along the second volute.

The just described double volute casing exhibits the advantage that its weight, bulk and cost are a relatively small fraction of the weight, bulk and cost of heretofore known double volute casings, for example, casings of the type disclosed in German Offenlegungsschrift No. 26 40 866. However, and since the casings are normally made by resorting to a casting technique, the making of a double volute casing with one or more channels which flank the second volute and serve to connect the end of the first volute with an outlet nozzle for both volutes can present serious problems.

OBJECTS AND SUMMARY OF THE INVENTION

An object of the invention is to provide a centrifugal pump with a novel and improved double volute casing of the type wherein the end of the first volute is connected with the common outlet nozzle for both volutes by one or more channels and to construct and assemble the casing in such a way that its constituents can be readily manufactured in accordance with heretofore known techniques and by resorting to available machinery or apparatus.

Another object of the invention is to provide a novel and improved composite double volute casing for use in centrifugal pumps.

A further object of the invention is to provide a novel and improved double volute pump casing wherein the channel or channels between the end of the first volute and the outlet nozzle need not be formed by resorting to costly, lengthy and complex material removing procedures.

An additional object of the invention is to provide a double volute pump casing whose flow-enhancing characteristics are at least as satisfactory as those of heretofore known pump casings wherein the first volute communicates with the outlet nozzle by at least one channel.

Another object of the invention is to provide a centrifugal pump which embodies the above outlined double volute casing.

The invention is embodied in a centrifugal pump which comprises a casing including a main portion which has an axial passage and first and second arcuate volutes each of which extends along an arc of at most 180 degrees. The start of the second volute is adjacent to the end of the first volute and the end of the second volute communicates with an outlet or discharge nozzle of the main portion of the casing. The end of the first volute communicates with the outlet nozzle by way of one or more channels which are formed in the main portion and extend along the second volute. In accordance with a feature of the invention, each channel has an arcuate open side facing the axial passage of the main portion and the casing further comprises a preferably removable tubular insert for each channel. Each insert is disposed between the passage and the respective channel to seal the inner side of the corresponding channel from the passage. Such insert or inserts can be separably secured to the main portion by means of screws, bolts or analogous fasteners. It is preferred to provide one or more annular or arcuate seals, e.g., O-rings, between each insert and the main portion of the casing. The outer diameter of the main portion of the casing equals or approximates the outer diameter of the end of the first volute.

The passage receives the customary pump shaft which carries the impeller (the impeller may be a single-suction impeller or a double-suction impeller). Alternatively, that part of the passage which is adjacent to the volutes and to the channel or channels of the main portion may receive a stationary guide wheel or diffuser which is installed downstream of the impeller.

The main portion of the casing may constitute a substantially cylindrical one piece casting with two parallel end faces. The volutes are then disposed substantially midway between the end faces of the casting and are flanked by the inserts which constitute short tubes, it being assumed here that the main portion of the casing has two channels with open sides facing the axial passage of the main portion. The main portion of the casing has an internal surface which can be provided with a discrete recess for each insert; such recesses can be machined into the main portion, i.e., the casting can be treated in a material removing machine to form the recess or recesses.

In accordance with a presently preferred embodiment, the main portion of the casing has two arcuate channels which are mirror symmetrical to each other with reference to a plane normal to the axis of the passage, i.e., extending at right angles to the axis of the main portion.

The novel features which are considered as characteristic of the invention are set forth in particular in the appended claims. The improved centrifugal pump itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
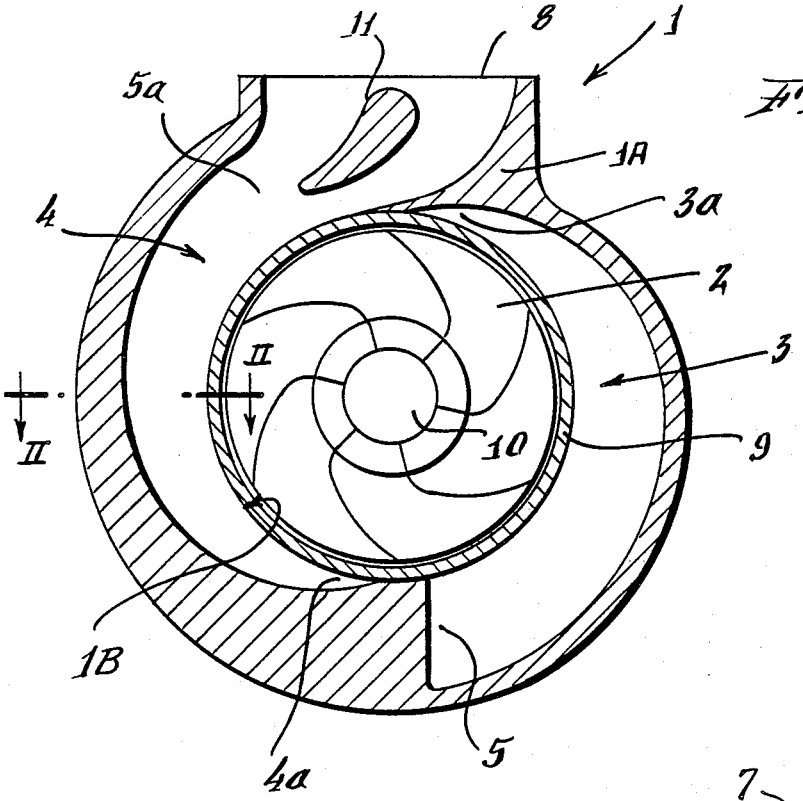
FIG. 1 is a transverse sectional view of a centrifugal pump having a double volute casing which embodies one form of the invention.

The centrifugal pump of FIG. 1 has a pump shaft 10 which drives an impeller 2. The latter is surrounded by a double volute pump casing 1 including a main portion 1A and two tubular inserts 9. The impeller 2 draws or urges the fluid into a centrally located axial passage 1B of the main portion 1A. The latter is formed with two arcuate volutes 3 and 4 which are located diametrically opposite each other and each of which extends along an arc of at most 180 degrees. The start 3*a* of the first volute 3 is adjacent to an outlet nozzle or discharge nozzle 8 of the main portion 1A, and the end 5*a* of the second volute 4 communicates directly with the nozzle 8. The connection between the end 5 of the first volute 3 and the nozzle 8 comprises at least one but preferably two arcuate channels 6 and 7 which extend from the end 5 of the first volute 3, along the second volute 4, and to the outlet nozzle 8. The nozzle 8 contains a guide rib 11 which enhances the flow of fluid from the interior of the main portion 1A. The outer diameter of the substantially cylindrical main portion 1A equals or approximates the outer diameter of the first volute 3 in the region of the end 5. The start 4*a* of the second volute 4 is adjacent to the end 5 of the first volute 3.

Figure 2:
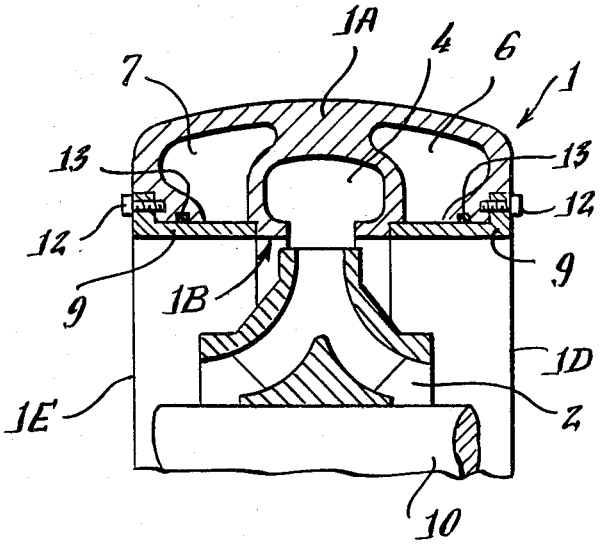
FIG. 2 is a fragmentary sectional view as seen in the direction of arrows from the line II—II of FIG. 1.

The main portion 1A has two parallel or nearly parallel end faces 1D, 1E (see FIG. 2), and the volutes 3, 4 (only the volute 4 is shown in FIG. 2) are located midway or nearly midway between such end faces. The channels 6 and 7 flank the volute 4 and are mirror symmetrical to each other with reference to a plane which is normal to the axis of the main portion 1A, i.e., to the axis of the shaft 10 and passage 1B.

The inner sides of the channels 6 and 7 are open toward the passage 1B. Such inner sides are sealed by the respective tubular inserts 9 which are inserted into the main portion 1A and are separately affixed thereto by screws 12 or analogous fastener means. The reference characters 13 denote O-rings or analogous sealing elements which are installed in recesses machined in the internal surface of the main portion 1A to prevent the outflow of fluid from the respective channels 6 and 7 toward the corresponding end faces 1D and 1E of the main portion 1A. The heads of the screws 12 are accessible from the end faces 1D, 1E of the main portion 1A.

Figure 3:
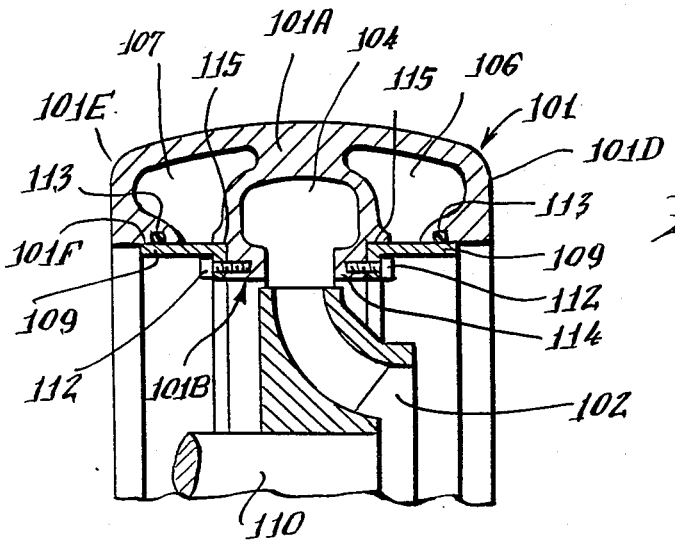
FIG. 3 is a similar fragmentary sectional view of a modified centrifugal pump.

FIG. 3 illustrates a portion of a modified centrifugal pump wherein the double-suction impeller 2 of FIGS. 1 and 2 is replaced with a single-suction impeller 102. The main portion 101A of the pump casing 101 has two channels 106, 107 whose open sides are sealed from the axial passage 101B for the impeller 102 and pump shaft 110 by two discrete tubular inserts 109 which are not immediately accessible at the respective end faces 101D, 101E of the main portion 101A. The internal surface 101F of the main portion 101A is formed with two mirror symmetrical recesses 115 for the inserts 109. These recesses can be formed in a suitable material removing machine. Each insert 109 is secured to the main portion 101A by an annulus of screws or analogous fasteners 112 whose shanks extend into tapped bores machined into the internal ribs 114 flanking the second volute 104. The reference characters 113 denote two sealing rings which are interposed between the inserts 109 and the adjacent portions of the internal surface 101F. The surface 101F can have annular grooves for such sealing rings.

An important advantage of the improved pump casing is that its main portion 1A or 101A can constitute a one-piece casting which can be readily produced in accordance with heretofore known casting techniques. Furthermore, and since the inner sides of the channels 6, 7 or 106, 107 are open, the surfaces bounding these channels can be readily finished with a high degree of precision so as to reduce the drag resistance. The same holds true for the internal surfaces of the volutes. In many instances, the surfaces in the channels and/or volutes will be treated by grinding or by resort to an analogous material removing technique.

Another important advantage of the improved double volute pump casing is that the main portion 1A or 101A can be readily inspected or tested because it affords convenient access to each of its parts. This renders it possible to rapidly detect eventual flaws in the casting and to correct such flaws without discarding the main portion.

The feature that the outer diameter of the main portion 1A or 101A is relatively small renders it possible to store a large number of such main portions in a small area. Still further, the mounting of the main portion 1A or 101A is simpler and more satisfactory than in systems which use centrifugal pumps with conventional double volute casings.

Since the interior of the main portion 1A or 101A can be finished with any desired degree of precision, the flow of fluid in the improved casing is much more satisfactory than in conventional double volute casings. Finally, and as already indicated hereinabove, ready accessibility of the interior of the main portion 1A or 101A renders it possible to finish the surfaces of the main portion by resorting to available grinding, polishing and analogous material removing machines. The same holds true for the machining of recesses 115 into the main portion 101A of the pump casing 101 shown in FIG. 3.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a centrifugal pump, the improvement comprising a casing including a housing having first and second volutes each of which extends along an arc of maximally 180 degrees, said volutes having starts and ends and the start of said second volute being adjacent to the end of said first volute, the outer diameter of said housing at least approximating the outer diameter of said first volute in the region of the end of said first volute, and said housing further having an outlet nozzle communicating with the end of said second volute and at least one channel extending from the end of said first volute, along said second volute and to said outlet nozzle, said housing also having a central passage and said channel having an open inner side facing said passage, said casing also comprising an arcuate insert installed in said housing and sealing the open side of said channel from said passage.

2. The improvement of claim 1, further comprising a shaft coaxially disposed in said passage and impeller means mounted on and receiving torque from said shaft.

3. The improvement of claim 1, wherein said housing has an additional channel extending from the end of said first volute, along said second volute and to said outlet nozzle, said second channel having an open inner side facing said passage; and further comprising a second arcuate insert installed in said housing and sealing the open side of said additional channel from said passage.

4. The improvement of claim 1, further comprising fastener means separably securing said insert to said housing.

5. The improvement of claim 1, further comprising, sealing means interposed between said insert and said housing.

6. The improvement of claim 1, wherein said insert is a tube.

7. The improvement of claim 1, wherein said housing is a one-piece casting.

8. The improvement of claim 1, wherein said housing has an internal surface provided with a recess for said insert.

9. The improvement of claim 1, wherein said housing has two parallel end faces and said volutes are disposed substantially midway between said end faces.

10. The improvement of claim 1, wherein said housing has an additional channel extending from the end of said first volute, along said second volute and to said outlet nozzle, said second volute being disposed between said channels.

11. The improvement of claim 10, wherein said channels are mirror symmetrical to each other with reference to a plane which is normal to the axis of said housing.

12. A centrifugal pump comprising a casing which includes a housing provided with a volute having a start and an end, said housing also being provided with an axial passage, an outlet nozzle remote from said end, and a channel which extends from said end to said outlet nozzle and has an open inner side adjacent to said passage, said casing further including an insert which is installed in said housing and closes said open inner side to thereby seal said passage from said channel.

* * * * *